US009194570B2

(12) United States Patent
Wakamiya et al.

(10) Patent No.: US 9,194,570 B2
(45) Date of Patent: Nov. 24, 2015

(54) LAMP AND LIGHTING APPARATUS

(75) Inventors: Akihito Wakamiya, Hyogo (JP); Akio Kitada, Osaka (JP); Tomokazu Matsuura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 34 days.

(21) Appl. No.: 13/817,018

(22) PCT Filed: Nov. 9, 2011

(86) PCT No.: PCT/JP2011/006274

§ 371 (c)(1),
(2), (4) Date: Feb. 14, 2013

(87) PCT Pub. No.: WO2012/063488

PCT Pub. Date: May 18, 2012

(65) Prior Publication Data

US 2013/0141922 A1 Jun. 6, 2013

(30) Foreign Application Priority Data

Nov. 9, 2010 (JP) ..... 2010-251340

(51) Int. Cl.
*F21V 29/00* (2015.01)
*F21K 99/00* (2010.01)
*F21V 15/01* (2006.01)
(Continued)

(52) U.S. Cl.
CPC . *F21V 29/00* (2013.01); *F21K 9/30* (2013.01); *F21K 9/58* (2013.01); *F21V 15/01* (2013.01); *F21V 15/012* (2013.01); *F21V 23/02* (2013.01); *F21V 29/004* (2013.01);
(Continued)

(58) Field of Classification Search
CPC ..... F21V 7/043; F21V 29/00; F21S 2/00
USPC ..... 362/646, 647, 649, 294, 373
See application file for complete search history.

(56) References Cited

U.S. PATENT DOCUMENTS 8,197,097 B2 6/2012 Ogawa et al.
2005/0073848 A1 * 4/2005 King et al. ..... 362/296
(Continued)

FOREIGN PATENT DOCUMENTS

EP 2124255 11/2009
EP 2221529 8/2010
(Continued)

OTHER PUBLICATIONS

International Search Report, mail date is Feb. 14, 2012.
(Continued)

*Primary Examiner* — Evan Dzierzynski
*Assistant Examiner* — Christopher E Dunay
(74) *Attorney, Agent, or Firm* — Greenblum & Bernstein, P.L.C.

(57) ABSTRACT

A lamp capable of efficiently dissipating heat generated in a semiconductor light-emitting element is provided. A lamp which emits light includes: a mounting board on which a semiconductor light-emitting element is mounted; a first housing thermally coupled with the mounting board; and a second housing including a power receiving unit which receives power for causing the semiconductor light-emitting element to emit light. The first housing is disposed closer to an illuminated area than the second housing is, and includes a first exposed surface exposed at least to the illuminated area.

16 Claims, 13 Drawing Sheets

(51) Int. Cl.

| | |
|---|---|
| ***F21V 23/02*** | (2006.01) |
| ***F21V 29/507*** | (2015.01) |
| ***F21V 29/70*** | (2015.01) |
| ***F21V 29/77*** | (2015.01) |
| *F21Y 101/02* | (2006.01) |

(52) U.S. Cl.
CPC ..... *F21V 29/507* (2015.01); *F21V 29/70* (2015.01); *F21V 29/773* (2015.01); *F21Y 2101/02* (2013.01)

(56) References Cited

U.S. PATENT DOCUMENTS

| | | | | |
|---|---|---|---|---|
| 2005/0168986 | A1* | 8/2005 | Wegner | 362/241 |
| 2005/0243559 | A1* | 11/2005 | Coushaine et al. | 362/294 |
| 2006/0187652 | A1 | 8/2006 | Doyle | |
| 2009/0103296 | A1* | 4/2009 | Harbers et al. | 362/234 |
| 2009/0268470 | A1* | 10/2009 | Okimura et al. | 362/311.02 |
| 2009/0290346 | A1 | 11/2009 | Ogawa et al. | |
| 2010/0097811 | A1 | 4/2010 | Betsuda | |
| 2010/0208473 | A1* | 8/2010 | Sakai et al. | 362/373 |
| 2010/0302788 | A1* | 12/2010 | Chang | 362/355 |
| 2011/0005919 | A1* | 1/2011 | Madocks et al. | 204/192.12 |
| 2011/0261572 | A1* | 10/2011 | Watanabe et al. | 362/373 |
| 2011/0291594 | A1 | 12/2011 | Tanaka et al. | |
| 2012/0002429 | A1 | 1/2012 | Watanabe et al. | |
| 2012/0224372 | A1 | 9/2012 | Ogawa et al. | |

FOREIGN PATENT DOCUMENTS

| | | | |
|---|---|---|---|
| JP | 2007-273209 | | 10/2007 |
| JP | 2008-140606 | | 6/2008 |
| JP | 2008-300207 | | 12/2008 |
| JP | 2008300207 | A * | 12/2008 |
| JP | 2009-37995 | | 2/2009 |
| JP | 2009037995 | A * | 2/2009 |
| JP | 2009-181838 | | 8/2009 |
| JP | 2009181838 | A * | 8/2009 |
| JP | 2010-97890 | | 4/2010 |
| JP | 2010097890 | A * | 4/2010 |
| JP | 2010-157377 | | 7/2010 |
| JP | 2010-192336 | | 9/2010 |
| JP | 2010-192337 | | 9/2010 |

OTHER PUBLICATIONS

Japan Office action, mail date is Jan. 28, 2014.
Search report from E.P.O., mail date is Oct. 1, 2013.

* cited by examiner

LAMP AND LIGHTING APPARATUS

TECHNICAL FIELD

The present invention relates to a lamp in which a semiconductor light-emitting element is employed as a light source, and a lighting apparatus including the lamp.

BACKGROUND ART

Conventionally, an LED lamp which includes a GX53 base is available as an LED lamp in which a light-emitting diode is used as a light source.

The LED lamp generally includes: a disk-shaped GX53 base disposed on a lighting equipment area; a metal cover having an upper surface to which the base is attached; an LED substrate attached to the metal cover on an illuminated area; and a resin translucent cover attached to the metal cover to cover the LED substrate. In addition, an LED is mounted on the LED substrate, and a lighting circuit for lighting the LED is stored inside the base.

Among the above-described LED lamps, Patent Literature 1 discloses an LED lamp in which a metal cover and a translucent cover are fitted such that the metal cover and the translucent cover are in thermal contact with each other on a side surface of the LED lamp. With this configuration, heat generated due to lighting of the LED is dissipated into the atmosphere not only from the side surface of the metal cover but also from the translucent cover. Furthermore, the heat is also dissipated from the upper surface of the metal cover to outside via the base. In the above-described manner, thermal influence to the LED or the lighting circuit is reduced.

CITATION LIST

Patent Literature

[PTL 1] Japanese Unexamined Patent Application Publication No. 2010-192337

SUMMARY OF INVENTION

Technical Problem

However, when a flat lamp using the GX53 base or the like is installed in lighting equipment, heat is likely to be trapped and the heat dissipation performance is poor, and thus the heat cannot be sufficiently dissipated with the conventional LED lamp disclosed by Patent Literature 1. Therefore, there is a problem that an increase in temperature of an LED causes performance degradation such as decrease in brightness of the LED or shortening of the product life of the LED.

More specifically, with the above-described conventional LED lamp, it is possible to obtain desired heat dissipation performance under conditions of natural convection when lighting a lamp in the state where only the lamp floats in the air (single lighting). However, an LED lamp that employs a GX53 base is used as being mounted on lighting equipment formed to cover the LED lamp, and thus the heat dissipation effect resulting from the natural convection cannot be expected. In particular, when installed in lighting equipment that has a heat insulated structure, heat that is supposed to be dissipated is stagnant and stays in the lighting equipment, and thus the heat dissipation performance resulting from the natural convection decreases. Accordingly, the effect of decreasing temperature of an LED cannot be obtained as much as expected. In addition, with a resin translucent cover, it is difficult to efficiently dissipate heat into the atmosphere through the translucent cover, not to mention it is not possible to efficiently transfer heat to the translucent cover.

The present invention is conceived to solve the above-described problem, and an object of the present invention is to provide a lamp and a lighting apparatus which are capable of efficiently dissipating heat generated in a semiconductor light-emitting element.

Solution to Problem

In order to solve the above-described problem, an aspect of a lamp according to the present invention is a lamp which emits light and includes: a mounting board on which a semiconductor light-emitting element is mounted; a first housing thermally coupled with the mounting board; and a second housing including a power receiving unit configured to receive power for causing the semiconductor light-emitting element to emit light, wherein the first housing is disposed closer to an illuminated area than the second housing is, and includes a first exposed surface exposed at least to the illuminated area.

With this configuration, it is possible to conduct heat generated in the semiconductor light-emitting element to the first housing via the mounting board, and efficiently transfer the heat to external air via the first exposed surface portion of the first housing which is exposed to cool external air on the illuminated area. Accordingly, it is possible to efficiently dissipate heat generated in a semiconductor light-emitting element.

In addition, in an aspect of the lamp according to the present invention, it is preferable that the first housing further includes a second exposed surface exposed to a lateral side of the lamp, and the first housing has a bend to form the first exposed surface and the second exposed surface.

In addition, in an aspect of the lamp according to the present invention, it is preferable that the lamp further includes a translucent cover disposed closer to the illuminated area than the mounting board is.

In addition, in an aspect of the lamp according to the present invention, it is preferable that the first housing includes a protruding portion which protrudes toward the illuminated area to be higher than the mounting board, and the protruding portion has, as the first exposed surface, a surface facing the illuminated area.

In addition, in an aspect of the lamp according to the present invention, it is preferable that the protruding portion is formed into an annular shape to enclose the mounting board.

In addition, in an aspect of the lamp according to the present invention, it is preferable that the protruding portion has a height which is measured from the mounting board and which is set such that the protruding portion is formed in a region outside a range of a ½ beam angle of light emitted from the semiconductor light-emitting element.

In addition, in an aspect of the lamp according to the present invention, it is preferable that $h3<(D3-DL)/2\times3^{1/2}$, where h3 denotes a height of the protruding portion measured from the mounting board, D3 denotes an inner diameter of the protruding portion at an end facing the illuminated area, and DL denotes a maximum diameter of a region in which a sealing member for covering the semiconductor light-emitting device is formed.

In addition, in an aspect of the lamp according to the present invention, it is preferable that the first exposed surface has thermal conductivity higher than thermal conductivity of glass.

In addition, in an aspect of the lamp according to the present invention, it is preferable that the first exposed surface has emittance greater than or equal to 0.6.

In addition, in an aspect of the lamp according to the present invention, it is preferable that the second housing has thermal conductivity lower than thermal conductivity of the first exposed surface.

A lighting apparatus according to an aspect of the present invention includes the lamp and according to the above-described aspects and lighting equipment to which the lamp is attached, wherein the lighting equipment includes: an equipment body formed to cover the lamp, and a socket attached to the equipment body for supplying power to the lamp.

Advantageous Effects of Invention

With the lamp and the lighting apparatus according to the present invention, it is possible to efficiently dissipate, into the atmosphere, heat generated in a semiconductor light-emitting element. With this configuration, it is possible to suppress a temperature increase in the semiconductor light-emitting element, and also possible to suppress performance degradation and thermal deterioration of the semiconductor light-emitting device.

DESCRIPTION OF EMBODIMENTS

The following describes a lamp and a lighting apparatus according to exemplary embodiments of the present invention, with reference to the drawings. It is to be noted that the sizes, materials, shapes, and the like presented as examples in the exemplary embodiments arbitrarily change according to the configuration or various conditions of the device to which the present invention is applied, and thus the present invention is not limited to those examples. In sum, the present invention is specified by only the appended Claims. Therefore, among the structural elements in the following exemplary embodiments, structural elements not recited in any one of the independent claims which represent the most generic concepts are described as structural elements not indispensable for achieving the object of the present invention but included for more preferred configuration. It is to be noted that the sizes and the like are not strictly matched between the drawings.

Embodiment 1

Figure 1A:
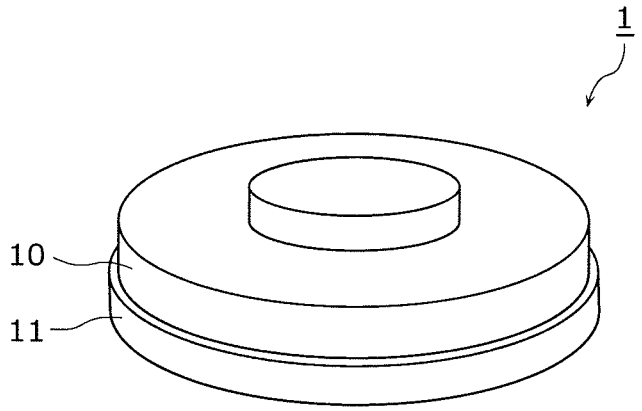
FIG. 1A is a perspective view of a lamp according to Embodiment 1 of the present invention when viewed from obliquely above.
Figure 1B:
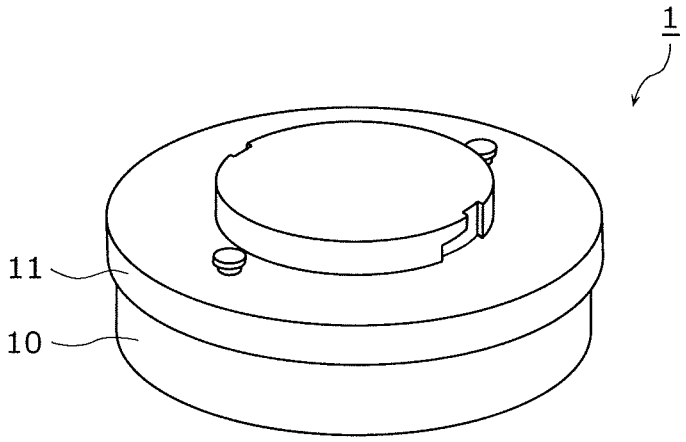
FIG. 1B is a perspective view of the lamp according to Embodiment 1 of the present invention when viewed from obliquely below.

First, a general configuration of a lamp 1 according to Embodiment 1 of the present invention will be described with reference to FIG. 1A and FIG. 1B. FIG. 1A is a perspective view of a lamp according to Embodiment 1 of the present invention when viewed from obliquely above. FIG. 1B is a perspective view of the lamp when viewed from obliquely below.

As shown in FIG. 1A and FIG. 1B, the lamp 1 according to Embodiment 1 of the present invention is an LED lamp which has a GX53 base and a disk-like or flat overall shape. The lamp 1 includes: a first housing 10 disposed to face an area to which light is emitted (illuminated area); and a second housing 11 disposed in an area which is opposite to the illuminated area and in which the lamp 1 is attached to lighting equipment (not illustrated) (lighting equipment area). In the exemplary embodiment, the illuminated area refers to the area toward which light proceeds, and the area to which light is taken out from the lamp 1 (light receiving side) with respect to the lamp 1.

Here, the illuminated area in FIG. 1A is illustrated to be positioned above the lamp 1, and the illuminated area in FIG. 1B is illustrated to be positioned below the lamp 1. Hereafter, in the exemplary embodiment, above (an upper side) and below (a lower side) are defined based on the state where an LED lamp is disposed such that the illuminated area is positioned on the upper side as illustrated in FIG. 1A.

Figure 2A:
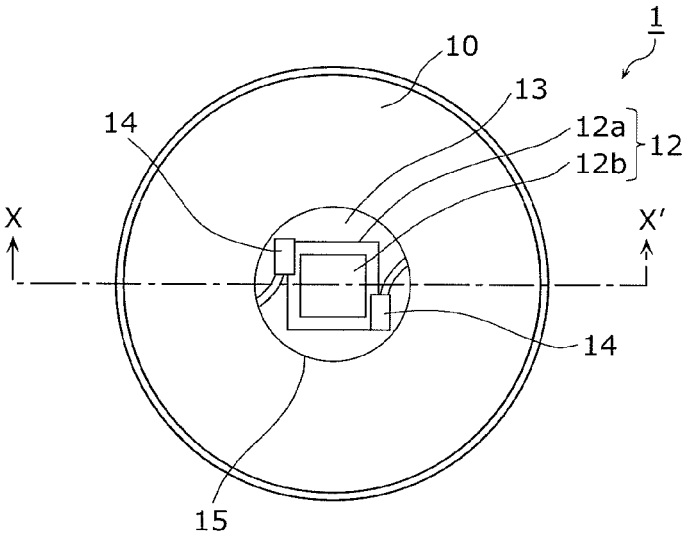
FIG. 2A is a plan view of the lamp according to Embodiment 1 of the present invention.
Figure 2B:
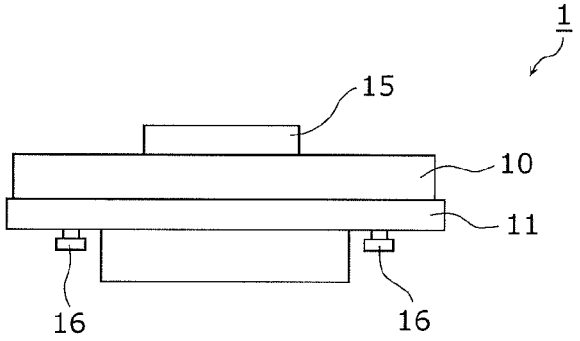
FIG. 2B is a side view of the lamp according to Embodiment 1 of the present invention.

Next, a detailed configuration of the lamp 1 according to Embodiment 1 of the present invention will be described with reference to FIG. 2A to FIG. 2C. FIG. 2A is a plan view of the lamp according to Embodiment 1 of the present invention. FIG. 2B is a side view of the lamp, and FIG. 2C is a cross-sectional view of the lamp, which is taken from line X-X' of FIG. 2A.

Figure 2C:
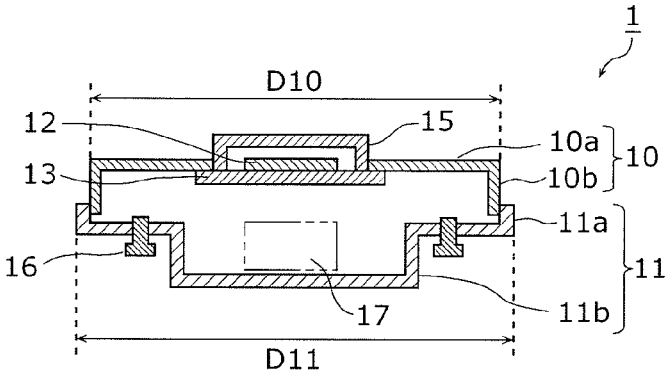
FIG. 2C is a cross-sectional view of the lamp according to Embodiment 1 of the present invention, which is taken from line X-X' of FIG. 2A.

As shown in FIG. 2A to FIG. 2C, the lamp 1 according to Embodiment 1 of the present invention includes: the first housing 10; the second housing 11 (a second member); an LED module 12; a light source mounting member 13; a power supply terminal 14; a translucent cover 15; a pair of base pins 16; and a lighting circuit 17.

The first housing 10 is a member (a first member) for holding the LED module 12 (a mounting board 12*a*), which is disposed closer to the illuminated area than the second housing 11 is. The first housing 10 is formed of a material of high thermal conductivity such as a metal. In the exemplary embodiment, the first housing 10 is formed of a metal housing containing aluminum having the thermal conductivity of 237 [W/m·K].

In addition, the first housing 10 includes: a first exposed surface (an exposed surface on the illuminated area) 10*a* which is a surface exposed to the illuminated area (the upper side); and a second exposed surface 10*b* which is a surface exposed to a side of the lamp 1, in other words, to the lighting equipment area (lateral side). As described above, an outer surface of each of the first exposed surface 10*a* and the second exposed surface 10*b* is formed so as to be exposed to the atmosphere.

The first exposed surface 10*a* is formed of a planar portion having a circular opening in the center. The first exposed surface 10*a* is a visible portion of the first housing 10 when the lamp 1 according to the exemplary embodiment is viewed from above. The second exposed surface 10*b* is formed of a cylindrical portion which has a flat-disk cylindrical shape and is connected to an edge of the first exposed surface 10*a*. According to the exemplary embodiment, the first exposed surface 10*a* and the second exposed surface 10*b* are formed by bending part of the first housing 10 at a 90-degree angle the first housing 10 has a bend with a 90-degree angle in a portion thereof to form the first exposed surface 10*a* and the second exposed surface 10*b*.

In addition, according to the exemplary embodiment, an outermost diameter D10 of the first housing 10 is in a range from 30 mm to 150 mm, and preferably in a range from 65 mm to 85 mm. LED mounting boards generally available on the market cannot be installed when the diameter is below the above-described ranges. In contrast, it is difficult to hold the first housing 10 when the diameter is above the above-described ranges, resulting in significant decrease in handleability. It is to be noted that, the diameter is set to D10=72 mm in the exemplary embodiment.

The second housing 11 is a member (the second member) including a power receiving unit which receives power for lighting an LED of the LED module 12. The GX53 base configuration is employed to the second housing 11, and the second housing 11 is formed of a resin housing including a synthetic resin having insulation properties. In the exemplary embodiment, the second housing 11 is formed of PBT (polybutylene terephthalate).

In addition, the second housing 11 includes: a base portion 11*a* having a flat-disk cylindrical shape with a bottom; and a protruding portion 11*b* having a flat-disk cylindrical shape with a bottom. The protruding portion 11*b* is formed so as to protrude from a center portion of the bottom of the base portion 11*a* toward the area opposite to the illuminated area. It is to be noted that the bottom of the base portion 11*a* is a base reference surface, and the bottom of the protruding portion 11*b* is a base top panel.

According to the exemplary embodiment, an outermost diameter D11 of the second housing 11 is in a range from 60 mm to 150 mm, and preferably in a range from 65 mm to 75.2 mm. When the diameter is below or above the above-described ranges, the base portion does not meet IEC (International Electrotechnical Commission) standard, and thus the lamp 1 cannot be attached to a socket of the lighting equipment. It is to be noted that an outer diameter of a portion other than the base portion can be enlarged in the second housing 11, however, it becomes difficult to be held when the diameter is extremely enlarged, resulting in significant decrease in handleability. The outer diameter is set to D11=75 mm in the exemplary embodiment.

The first housing 10 and the second housing 11 configured as described above are fitted such that an outer cylindrical side surface of a side portion of the first housing 10 abuts on an inner cylindrical side surface of the base portion of the second housing 11. The first housing 10 and the second housing 11 can be fixed using a plurality of screws, for example. Alternatively, each of the first housing 10 and the second housing 11 may include a threading unit at a portion where the first housing 10 and the second housing 11 are abutted, and the first housing 10 and the second housing 11 are threaded together, thereby fixing the first housing 10 and the second housing 11 to each other.

The LED module 12 is a light source having a semiconductor light-emitting element. The LED module 12 includes an LED mounting board 12*a* and a light emitting unit 12*b* disposed on the LED mounting board 12*a*.

In the LED module 12, the LED mounting board 12*a* is a substrate for mounting LED chips. The LED mounting board 12*a* is formed of a flat plate, for example, and has one face on which the LED chips are mounted and the other face that is thermally connectable to the light source mounting member 13. It is preferable that the LED mounting board 12*a* be formed of a material with high thermal conductivity, and an alumina substrate made of alumina be used in the exemplary embodiment. It is to be noted that, as the LED mounting board 12*a*, other ceramics substrate such as aluminum nitride may be used other than the alumina substrate, or a metal core substrate or the like which has a stacking structure including a metal plate and a resin substrate may be used.

In the LED module 12, the light emitting unit 12*b* includes a plurality of LED chips (not illustrated) and a sealing member (not illustrated). The LED chips are mounted on the one face of the LED mounting board 12*a* through die bonding or the like. It is to be noted that, as the LED chips, blue emitting LED chips which emit blue light having a center wavelength of 440 nm to 470 nm are used, for example. In addition, the sealing member is a phosphor-containing resin formed of a resin which contains phosphor, for protecting the LED chips by sealing the LED chips as well as converting a wavelength of light emitted from the LED chips. As the sealing member, when the LED chips employ blue emitting LED, for example, a phosphor-containing resin formed by dispersing YAG (yttrium, aluminum, garnet) yellow phosphor particles on a silicone resin may be used for obtaining white light. With this configuration, the light emitting unit 12*b* (sealing member) emits white light resulting from yellow light having a wavelength converted by the phosphor particles and blue light from blue LED chips.

In addition, the light emitting unit 12*b* shaped into a rectangle is illustrated as an example in the exemplary embodiment, however, the shape or the configuration of the light emitting unit is not limited to rectangle according to the present invention. For example, a round light emitting unit may be employed. In addition, the case where two power supply terminals are present is illustrated as an example in the exemplary embodiment, however, there may be only a single power supply terminal when a lead is parallel or coaxial.

The light source mounting member 13 is a mounting seat on which the LED module 12 (light source) is mounted, and can be formed of a plate component, for example. It is preferable that the light source mounting member 13 be formed of a material with high thermal conductivity, and an aluminum plate made of aluminum be used in the exemplary embodiment. It is to be noted that the light source mounting member 13 may be molded integrally with the first housing 10.

The light source mounting member 13 has one face on which the LED mounting board 12*a* of the LED module 12 is fixed in contact with each other. With this configuration, the light source mounting member 13 and the LED mounting board 12*a* are thermally coupled.

In addition, the light source mounting member 13 is attached to an inner face of the first exposed surface 10*a* of the first housing 10 in such a manner that the light source mounting member 13 covers the opening of the first housing 10. The light source mounting member 13 and the first housing 10 are attached so as to come in contact with each other. With this configuration, the light source mounting member 13 and the first housing 10 are thermally coupled. It is to be noted that the light source mounting member 13 and the first housing 10 can be fixed using a plurality of screws. In addition, the light source mounting member 13 may be attached to an outer face of the first exposed surface 10*a* of the first housing 10. In addition, from the perspective of the heat dissipation performance, it is preferable that the light source mounting member 13 and the portion close to the opening of the first housing 10 come in contact with each other in a large area. This is because, as the contacting area is larger, the heat dissipation performance is more likely to increase because heat generated from the LED module 12 is transferred to the housing.

The power supply terminal 14 is electrically connected to an electrode terminal (not illustrated) formed on the LED mounting board 12*a* of the LED module 12, and also electrically connected to the lighting circuit 17 via the lead. Power from the lighting circuit 17 is supplied to the LED module 12 via the lead and the power supply terminal 14. With this configuration, the LED chips of the LED module 12 emit light.

The translucent cover 15 is disposed closer to the illuminated area than the mounting board 12*a* is so as to cover the LED module 12 in order to protect the light emitting unit 12*b* of the LED module 12. In the exemplary embodiment, the translucent cover 15 is made of a flat-disk cylindrical member with a bottom. In addition, the translucent cover 15 is made of a synthetic resin material with high optical transmittance so as to transmit light emitted from the light emitting unit 12*b* of the LED module 12. Furthermore, in the exemplary embodiment, a coating material for promoting light diffusion properties is applied to an inner face of the translucent cover 15. It is to be noted that the translucent cover 15 is disposed in the opening of the first housing 10 and fixed to the light source mounting member 13. In addition, the coating material for promoting the light diffusion properties may arbitrarily be used as necessary.

The pair of base pins 16 are power receiving units for receiving AC power. The pair of base pins 16 protrude out from the bottom surface of the base portion 11*a* of the second housing 11, and are disposed symmetrically with respect to the center of the lamp 1. The AC power received by the base pins 16 is provided to the lighting circuit 17 via the lead. Each of the base pins 16 has a flange at an end portion so as to be engaged with the socket of the lighting equipment.

The lighting circuit 17 is a power supply circuit for causing the LED chips of the LED module 12 to emit light, and includes: a circuit element (electronic component) for converting the AC power received by the base pins 16 into DC power; and a circuit board for mounting the circuit element. The lighting circuit 17 has an input unit electrically coupled to the pair of base pins 16 via leads or the like, and has an output unit electrically coupled to the LED module 12 via leads or the like. Power converted by the lighting circuit 17 is supplied to the LED module 12 via the power supply terminal 14. It is to be noted that, although the lighting circuit 17 is positioned inside the protruding portion 11*b* of the second housing 11 according to the exemplary embodiment, the position is not specifically limited and may arbitrarily be designed.

With the lamp 1 according to Embodiment 1 of the present invention as described above, heat generated in the LED while the lamp 1 is lighting is conducted to the first housing 10 via the LED mounting board 12*a* and the light source mounting member 13. In the lamp 1 according to the exemplary embodiment, the first exposed surface 10*a* of the first housing 10 is exposed to the atmosphere in the illuminated area. Here, there is no obstacle other than an illuminated item in the illuminated area, and thus a neighboring region of the lamp in the illuminated area faces an area of external air cooled by natural convection. Accordingly, the heat conducted to the first housing 10 is transferred to the first exposed surface 10*a*, and transferred, from the first exposed surface 10*a*, to the cool external air that is in contact with the first exposed surface 10*a*. As a result, it is possible to efficiently dissipate heat.

In addition, it is preferable that the thermal conductivity of the second housing 11 be lower than the thermal conductivity of the first housing 10, in the lamp 1 according to the exemplary embodiment. With this configuration, the thermal resistance of the second housing 11 is larger than the thermal resistance of the first housing 10, and thus the heat conducted to the first housing 10 is efficiently dissipated into the atmosphere not from the second housing 11 but from the exposed surface of the first housing 10.

Embodiment 2

Figure 3A:
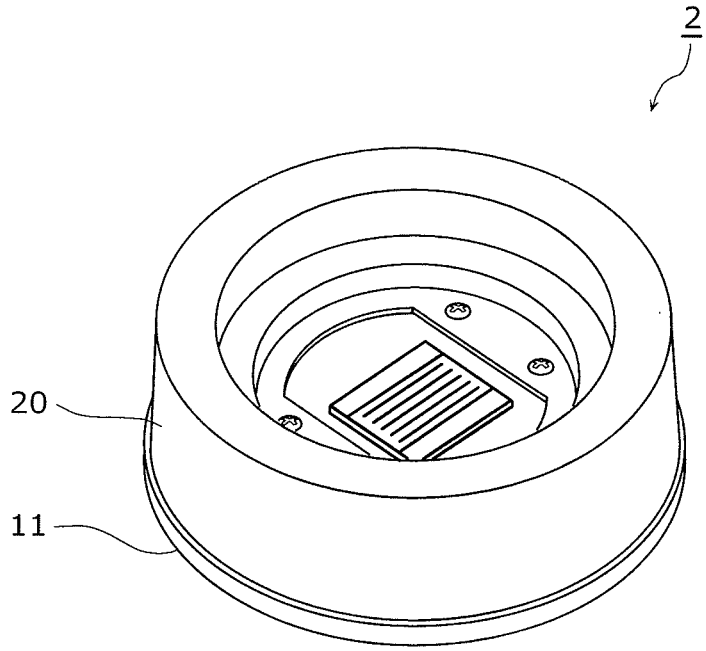
FIG. 3A is a perspective view of a lamp according to Embodiment 2 of the present invention when viewed from obliquely above.
Figure 3B:
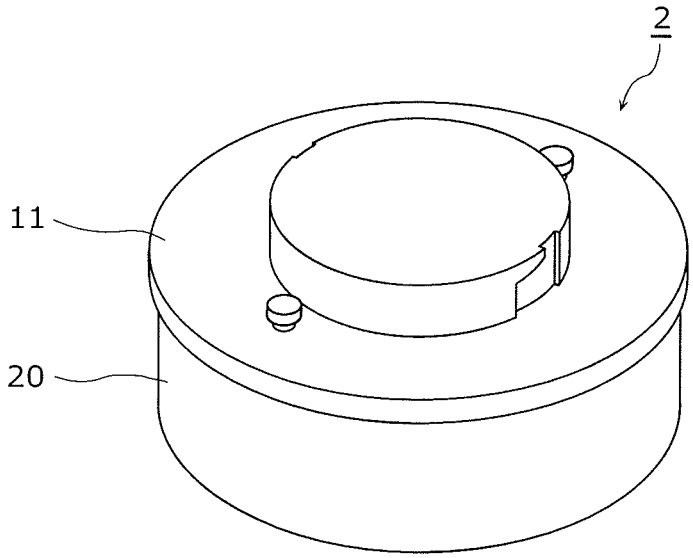
FIG. 3B is a perspective view of the lamp according to Embodiment 2 of the present invention when viewed from obliquely below.

Next, a general configuration of a lamp 2 according to Embodiment 2 of the present invention will be described with reference to FIG. 3A and FIG. 3B. FIG. 3A is a perspective view of a lamp according to Embodiment 2 of the present invention when viewed from obliquely above. FIG. 3B is a perspective view of the lamp when viewed from obliquely below. It is to be noted that, in FIG. 3A and FIG. 3B, structural elements which are the same as the structural elements shown in FIG. 2A and FIG. 2B are assigned with the same reference signs, and detailed description for them are omitted or simplified.

As shown in FIG. 3A and FIG. 3B, the lamp 2 according to Embodiment 2 of the present invention is an LED lamp which has a GX53 base and a disk-like or flat overall shape, as with Embodiment 1. The lamp 2 includes: a first housing 20 disposed on the illuminated area; and a second housing 11 disposed on the lighting equipment area.

In addition, as with Embodiment 1, the illuminated area in FIG. 3A is illustrated to be on the upper side, and the illuminated area in FIG. 3B is illustrated to be on the lower side. It is to be noted that, as with Embodiment 1, above (the upper side) and below (the lower side) are defined based on the state where the lamp is disposed such that the illuminated area is on the upper side, also in this exemplary embodiment.

Figure 4A:
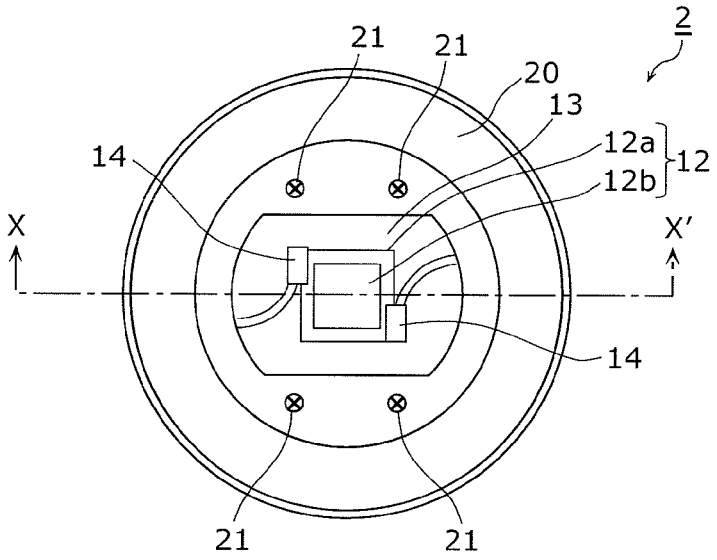
FIG. 4A is a plan view of the lamp according to Embodiment 2 of the present invention.
Figure 4B:
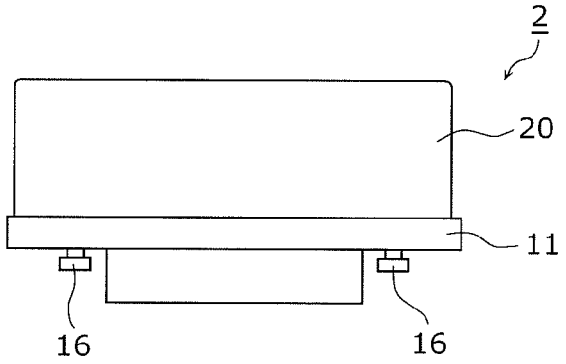
FIG. 4B is a side view of the lamp according to Embodiment 2 of the present invention.
Figure 4C:
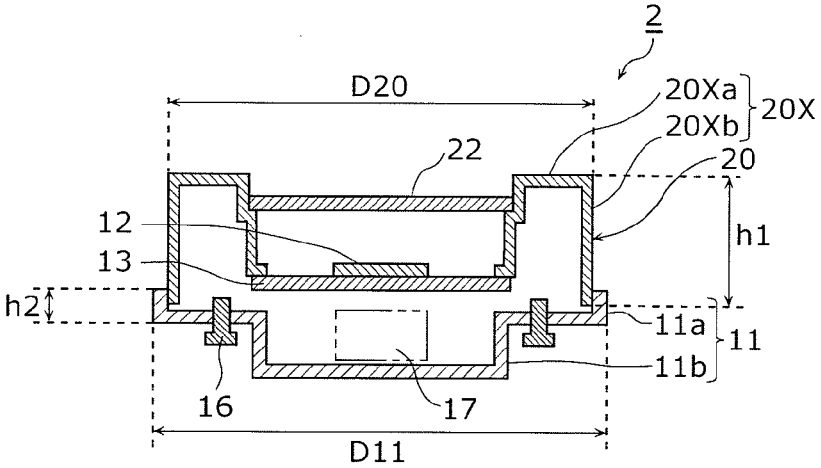
FIG. 4C is a cross-sectional view of the lamp according to Embodiment 2 of the present invention, which is taken from line X-X' of FIG. 4A.

Next, a detailed configuration of the lamp 2 according to Embodiment 2 of the present invention will be described with reference to FIG. 4A to FIG. 4C. FIG. 4A is a plan view of a lamp according to Embodiment 2 of the present invention. FIG. 4B is a side view of the lamp, and FIG. 4C is a cross-sectional view of the lamp, which is taken from line X-X' of FIG. 4A. It is to be noted that, in FIG. 4A to FIG. 4C, structural elements which are the same as the structural elements shown in FIG. 2A and FIG. 2B are assigned with the same reference signs, and detailed description for them are omitted or simplified.

As shown in FIG. 4A to FIG. 4C, the lamp 2 according to Embodiment 2 of the present invention includes: the first housing 20; the second housing 11; the LED module 12; the light source mounting member 13; the power supply terminal 14; a translucent cover 22; the pair of base pins 16; and the lighting circuit 17.

The first housing 20 is a member (the first member) for holding the LED module 12 (a mounting board 12*a*), which is disposed closer to the illuminated area than the second housing 11 is. The first housing 20 is formed of a material of high thermal conductivity such as a metal. In this exemplary embodiment, the first housing 20 is formed of a metal housing containing aluminum, as with Embodiment 1.

In addition, the first housing 20 has a protruding portion 20X formed so as to protrude more to the illuminated area than the mounting board 12*a*. More specifically, the first housing 20 is formed so as to have a recess sinking toward the second housing 11.

The protruding portion 20X of the first housing 20 is formed into an annular shape to surround the LED module 12. In addition, the protruding portion 20X of the first housing 20 includes: a first exposed surface (an exposed surface on the illuminated area) 20Xa which is a surface exposed to the illuminated area (the upper side); and a second exposed surface 20Xb which is a surface exposed to a side of the lamp 2, in other words, to the lighting equipment area (lateral side). As described above, an outer surface of each of the first exposed surface 20Xa and the second exposed surface 20Xb is formed so as to be exposed to the atmosphere.

The first exposed surface 20Xa is a top surface of the protruding portion 20X and formed of a planar portion having a circular opening in the center. In other words, the surface on the illuminated area of the protruding portion 20X is the first exposed surface 20Xa. The first exposed surface 20Xa is a visible portion of the first housing 20 when the lamp 2 according to the exemplary embodiment is viewed from above. The second exposed surface 20Xb is formed of a cylindrical portion which has a cylindrical shape and is connected to an edge of the first exposed surface 20Xa. According to the exemplary embodiment, the first housing 20 has a bend with a 90-degree angle in a portion thereof to form the first exposed surface 20Xa and the second exposed surface 20Xb.

In addition, the first housing 20 has an opening in an inner bottom surface thereof, and the light source mounting member 13 is exposed to the opening. It is to be noted that the light source mounting member 13 and the inner bottom surface of the first housing 20 are fixed with screws 21 according to the exemplary embodiment. In addition, although the light source mounting member 13 is attached to the inner face of the inner bottom of the first housing 20, the light source mounting member 13 may be attached to an outer face of the inner bottom surface of the first housing 20. It is to be noted that, although the method of fixing the light source mounting member 13 to the first housing 20 with screws 21 is described in the exemplary embodiment, the fixing method is not specifically limited. For example, an adhesive member such as an adhesive agent may be used for fixation, or fitting members which fit together may be provided to the housing and the light source mounting member for fixation.

According to the exemplary embodiment, an outermost diameter D20 of the first housing 20 is in a range from 30 mm to 150 mm, and preferably in a range from 65 mm to 85 mm, as with Embodiment 1. The diameter is set to D20=72 mm in the exemplary embodiment. In addition, the height of the first housing 20, that is, the height h1 of the protruding portion 20X is in a range from 10 mm to 100 mm, and preferably in a range from 15 mm to 55 mm. When the height is below the above-described ranges, a sufficient area for heat dissipation cannot be obtained. In contrast, when the height is above the above-described ranges, the lamp includes a larger portion protruding from the lighting equipment, resulting in decrease in aesthetic quality. The height is set to h1=20 mm in the exemplary embodiment. It is to be noted that, according to the present invention, the height h1 of the first housing refers to the length of a vertical line extending from a given point in the exposed surface of the first housing 20 down to a combination portion with the second housing 11 in the state where the first housing 20 is placed on a horizontal plane. For example, in FIG. 4C, the length of a vertical line extending from the first exposed surface 20Xa down to the second housing 11 in the state where the first housing 20 is placed on a horizontal plane.

The second housing 11 is configured in a similar manner to the second housing 11 of Embodiment 1. It is to be noted that the height h2 of the side portion of the base portion 11*a* of the second housing 11 (the height from the base reference surface) is in a range from 10 mm to 90 mm, and preferably in a range from 15 mm to 45 mm. The height that falls below the above-described ranges does not meet the IEC standard, and thus the lamp 2 cannot be attached to the socket of the lighting equipment. When the height is above the above-described ranges, the lamp includes a larger portion protruding from the lighting equipment, resulting in decrease in aesthetic quality. The height is set to h2=20 mm in the exemplary embodiment.

It is to be noted that the first housing 20 and the second housing 11 can be fixed together in the same manner as that in Embodiment 1.

The translucent cover 22 is disposed closer to the illuminated area than the mounting board 12*a* is, and formed to cover the LED module 12 in order to protect the light emitting unit 12*b* of the LED module 12. The translucent cover 22 is formed of a circular plate component in the exemplary embodiment. In addition, the translucent cover 22 is made of a synthetic resin material with high transmittance so as to transmit light emitted from the light emitting unit 12*b* of the LED module 12. Furthermore, in the exemplary embodiment, a coating material for promoting light diffusion properties is applied to an inner face of the translucent cover 22. It is to be noted that the translucent cover 22 is mounted on a stepped portion formed in the inner wall surface of the protruding portion 20X of the first housing 20, and fixed to the stepped portion with a plurality of rivets or screws, or with an adhesive agent or the like.

With the lamp 2 according to Embodiment 2 of the present invention as described above, heat generated in the LED while the lamp 2 is lighting is conducted to the first housing 20 via the LED mounting board 12*a* and the light source mounting member 13. In the lamp 2 according to the exemplary embodiment, the first exposed surface 20Xa of the first housing 20 is exposed to the atmosphere in the illuminated area. With this configuration, the heat conducted to the first housing 20 is transferred to the first exposed surface 20Xa, and transferred, from the first exposed surface 20Xa, to the cool external air that is in contact with the first exposed surface 20Xa, as with Embodiment 1. As a result, it is possible to efficiently dissipate heat.

In addition, the lamp 2 according to the exemplary embodiment includes the protruding portion 20X, and thus it is possible to further enhance heat dissipation performance compared to Embodiment 1. More specifically, not only the first exposed surface 20Xa but also second exposed surface 20Xb is present in a neighboring region of the lamp in the illuminated area which is surrounded by cool external air, according to the exemplary embodiment. With this configuration, it is possible to efficiently dissipate heat from the second exposed surface 20Xb as well, and thus it is possible to enhance the heat dissipation performance.

Figure 5:
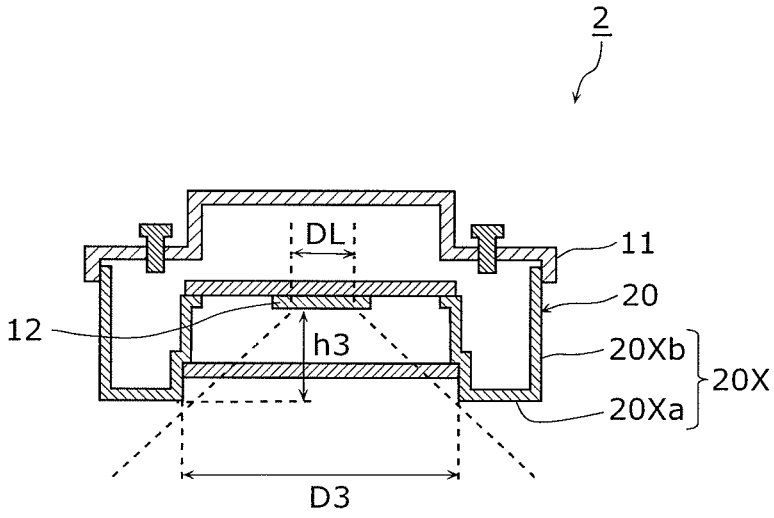
FIG. 5 is a cross-sectional view of the lamp according to Embodiment 2 of the present invention, which illustrates the state where the lamp is mounted so as to emit light downward.

Here, from the perspective of light distribution property, it is preferable that the protruding portion 2X of the first housing 20 be formed as below. FIG. 5 is a cross-sectional view of the lamp 2 according to Embodiment 2 of the present invention, which illustrates the state where the lamp 2 is mounted so as to emit light downward and is a diagram obtained by flipping the lamp 2 according to Embodiment 2 illustrated in FIG. 4C upside down.

Here, luminous intensity distribution of light emitted by the LED in the LED module 12 maintains Lambertian light distribution that is proportional to the cosine (cos $\alpha$) that forms an angle ($\alpha$) with respect to a light axis, and thus ½ beam angle is approximately 120 degrees. It is to be noted that the ½ beam angle is defined by determining a direction in which an intensity of light is half the largest intensity of the light emitted from a light emitting surface, and then determining as an angle twice as large as an angle between the light axis and the determined direction.

When a height of the protruding portion 20X of the first housing 20 measured from the mounting board 12*a* (the depth of a recess of the protruding portion 20X) is h3, since it is necessary to protect the LED module 12 from being exposed to the outside, the height h3 needs to be larger than 0. On the other hand, when the height h3 is overlarge, light emitted by the LED module 12 is reflected at the inner wall surface of the protruding portion 20X, so that the light distribution of emitted light of the lamp 2 is disturbed and the emitted light is partially absorbed. Here, when an inner diameter of an end of the protruding portion 20X which faces the illuminated area is D3 and the maximum diameter of the light emitting unit 12*b* (sealing member formed region) of the LED module 12 is DL, the maximum value of h3 is $(D3-DL)/2\times3^{1/2}$. In addition, even when a step is provided within the inner wall surface of the protruding portion 20X, it is preferable that the height h3 of the protruding portion 20X be set such that the protruding portion 20X is formed in a region outside a range of the ½ beam angle of light emitted from the LED module 12. In other words, it is preferable that the protruding portion 20X be provided at a region outside the range of the ½ beam angle of light emitted from the LED module 12.

In addition, with the lamp 2 according to the exemplary embodiment, it is possible to increase the exposed portion using the protruding portion 20X. More specifically, it is possible to increase the exposed portion not by enlarging an outer diameter of the lamp in the lateral direction (horizontal direction) but by enlarging the protruding portion 20X of the lamp toward the illuminated area. With this configuration, it is possible to ensure a separation distance between the lighting equipment (equipment body) and the lamp 2 when the lamp 2 is attached to the lighting equipment, thereby allowing a finger to enter the separation and facilitating attaching and detaching the lamp 2 to and from the lighting equipment. As described above, with the lamp 2 according to the exemplary embodiment, it is possible to maintain or enhance the heat dissipation performance, and also possible to increase the attachability to the lighting equipment.

It is to be noted that, as with the exemplary embodiment, it is preferable that the thermal conductivity of the second housing 11 be lower than the thermal conductivity of the first housing 20 in the lamp 2 according to the exemplary embodiment. With this configuration, the thermal resistance of the second housing 11 is larger than the thermal resistance of the first housing 10, and thus the heat conducted to the first housing 20 is efficiently dissipated into the atmosphere not from the second housing 11 but from the exposed surface of the first housing 20.

Embodiment 3

Figure 6A:
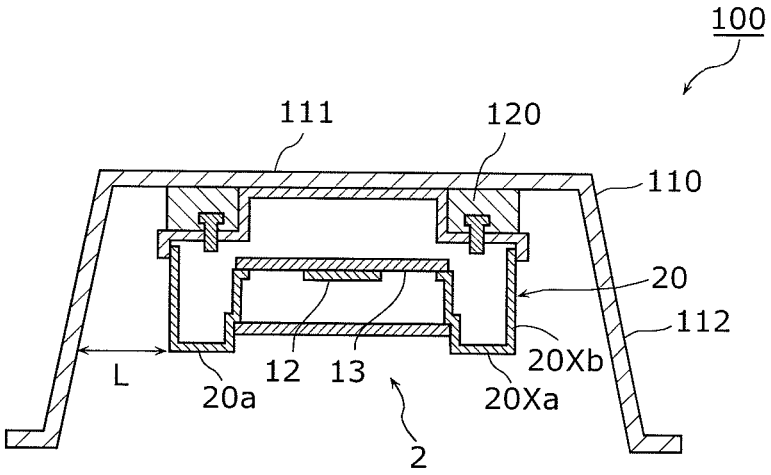
FIG. 6A is a cross-sectional view of a lighting apparatus according to Embodiment 3 of the present invention.
Figure 6B:
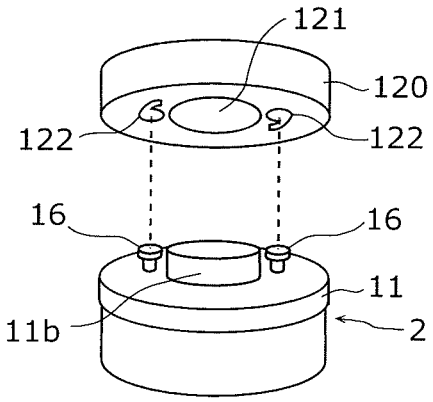
FIG. 6B is a diagram illustrating how a lamp is attached to a socket in a lighting apparatus according to Embodiment 3 of the present invention.

Next, a lighting apparatus 100 according to Embodiment 3 of the present invention will be described with reference to FIG. 6A and FIG. 6B. FIG. 6A is a cross-sectional view of a lighting apparatus according to Embodiment 3 of the present invention, and FIG. 6B is a diagram illustrating how a lamp is attached to a socket in the lighting apparatus according to Embodiment 3 of the present invention. It is to be noted that the lamp 2 according to Embodiment 2 of the present invention is used in the lighting apparatus according to the Embodiment 3. Accordingly, in FIG. 6A and FIG. 6B, structural elements which are the same as the structural elements shown in FIG. 4A and FIG. 4B are assigned with the same reference signs.

As shown in FIG. 6A, the lighting apparatus 100 according to Embodiment 3 of the present invention is a downlight, for example, and includes: lighting equipment having an equipment body 110 and a socket 120; and the lamp 2 according to Embodiment 2 of the present invention.

The equipment body 110 has a cup-like overall shape, is formed to entirely cover the lamp 2, and includes a flat plate portion 111 having a circular shape and a cylindrical portion 112 formed to have an inner diameter that gradually increases downwardly starting from a circumferential edge of the flat plate portion 111. The cylindrical portion 112 has an opening on the illuminated area. In addition, the cylindrical portion 112 is formed to reflect light from the lamp 2. The equipment body 110 is formed of a white synthetic resin having insulation properties according to the exemplary embodiment. It is to be noted that the equipment body 110 may include a reflection film coated on the inner face in order to enhance the reflectivity. In addition, an opening size of an opening edge of the equipment body 110 is 120 mm in the exemplary embodiment. It is to be noted that the equipment body to which the lamp of the present invention is applied is not limited to those made of synthetic resins, but metal equipment body formed by pressing a metal plate may be used.

The socket 120 corresponds to the GX53 base, and supplies AC power to the lamp 2. As shown in FIG. 6B, the socket 120 has a cylindrical shape, and includes: an insertion hole 121 in the center which penetrates through the socket 120 vertically; and a pair of coupling holes 122 (electrical coupling portions) on the bottom surface which are provided symmetrically with respect to the center of the socket 120. Each of the coupling holes 122 is a long hole having an arc-like shape and has an enlarged diameter portion formed at one end of the long hole. It is to be noted that a metal piece which serves as a coupling terminal for supplying power is placed inside the coupling hole 122.

In addition, the lamp 2 is removably attached to the socket 120.

When the lamp 2 is attached to lighting equipment that includes the equipment body 110 and the socket 120 according to the exemplary embodiment, the flange of each of the base pins 16 of the lamp 2 is inserted from the enlarged diameter portion of a corresponding one of the coupling holes 122 of the socket 120 as shown in FIG. 6B, the protruding portion 11*b* of the second housing 11 of the lamp 2 is inserted into the insertion hole 121 of the socket 120, and the lamp 2 is turned at a predetermined angle (for example, approximately 10 degrees). With this configuration, the base pins 16 are electrically coupled to the coupling terminals disposed inside the coupling holes 122, the flanges of the base pins 16 are caught on edge portions of the coupling holes 122, and the lamp 2 is held by the socket 120. With this configuration, it is possible to attach the lamp 2 to the lighting equipment, and to supply power to the lamp 2.

As described above, with the lighting apparatus 100 according to Embodiment 3 of the present invention, heat generated in the LED while the lamp 2 is lighting is conducted to the first housing 20 via the LED mounting board 12*a* and the light source mounting member 13. Since natural convection occurs to provide cool external air in the region on the illuminated area of the lamp 2, it is possible to dissipated the heat conducted to the first housing 20 efficiently into the atmosphere from the first exposed surface 20Xa that is exposed to the illuminated area (lower side).

In addition, since the lamp 2 includes the protruding portion 20X provided on the first housing 20, heat is dissipated not only from the first exposed surface 20Xa but also the second exposed surface 20Xb. With this configuration, it is possible to implement the lighting apparatus 100 having excellent heat dissipation performance.

It is to be noted that, although the lamp 2 according to Embodiment 2 is used in the lighting apparatus 100 according to this exemplary embodiment, the lamp 1 according to Embodiment 1 may be used.

MODIFICATION

The following describes five modification examples of the lamp according to the embodiments of the present invention with reference to FIG. 7A to FIG. 11. It is to be noted that, although each of the modification examples is described as a modification example of the lamp 2 according to Embodiment 2 of the present invention, it may be applied to the lamp 1 according to Embodiment 1 of the present invention. In addition, in each of the diagrams, structural elements which are the same as the structural elements shown in FIG. 4A and FIG. 4B are assigned with the same reference signs, and description for them are omitted.

Modification 1

Figure 7A:
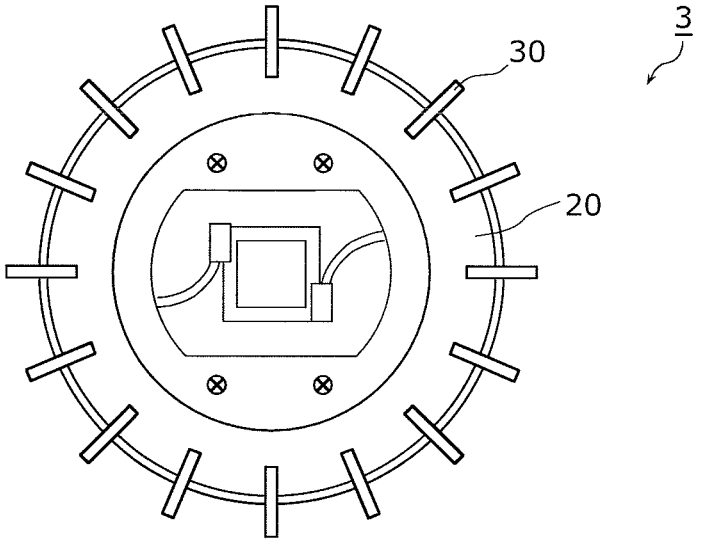
FIG. 7A is a plan view of a lamp according to Modification 1 of the present invention.

First, a lamp 3 according to Modification 1 of the present invention will be described with reference to FIG. 7A and FIG. 7B. FIG. 7A is a plan view of a lamp according to Modification 1 of the present invention, and FIG. 7B is a side view of the lamp according to Modification 1.

Figure 7B:
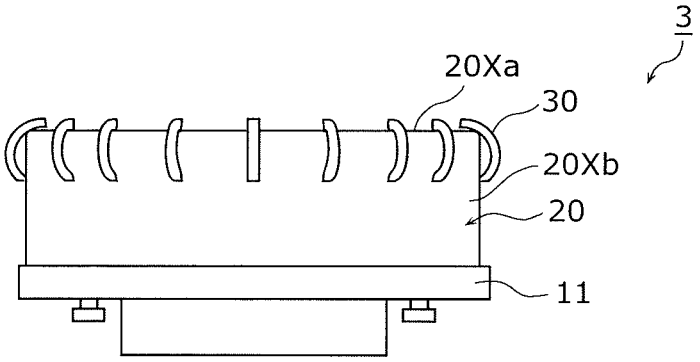
FIG. 7B is a side view of the lamp according to Modification 1 of the present invention.

As shown in FIG. 7A and FIG. 7B, the lamp 3 according to Modification 1 of the present invention is provided with a plurality of heat dissipation fins 30 on the upper portion (portion on the illuminated area) of the protruding portion 20X of the first housing 20. The heat dissipation fins 30 are formed to straddle the interface between the first exposed surface 20Xa and the second exposed surface 20Xb of the protruding portion 20X.

As described above, according to this modification, since the plurality of heat dissipation fins 30 are provided, it is possible to further enhance the heat dissipation performance compared to Embodiment 2. In addition, the heat dissipation fins 30 are formed on the protruding portion 20X to face the illuminated area that is a region containing cool external air, and thus it is possible to obtain a high heat dissipation effect.

Modification 2

Figure 8A:
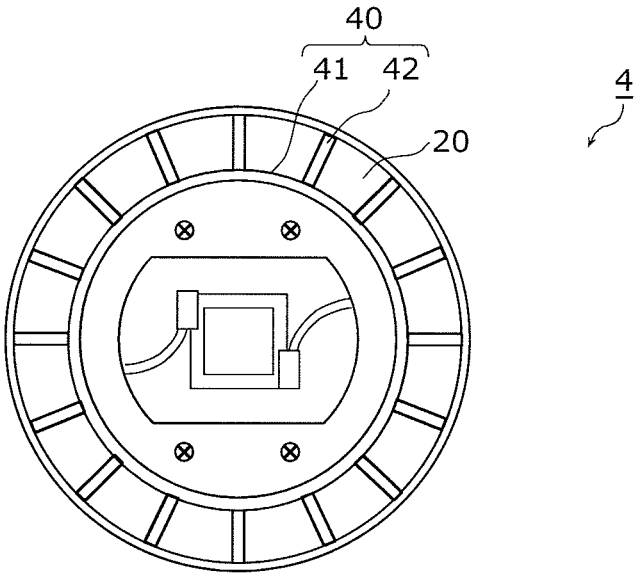
FIG. 8A is a plan view of a lamp according to Modification 2 of the present invention.

Next, a lamp 4 according to Modification 2 of the present invention will be described with reference to FIG. 8A and FIG. 8B. FIG. 8A is a plan view of a lamp according to Modification 2 of the present invention, and FIG. 8B is a side view of the lamp according to Modification 2.

Figure 8B:
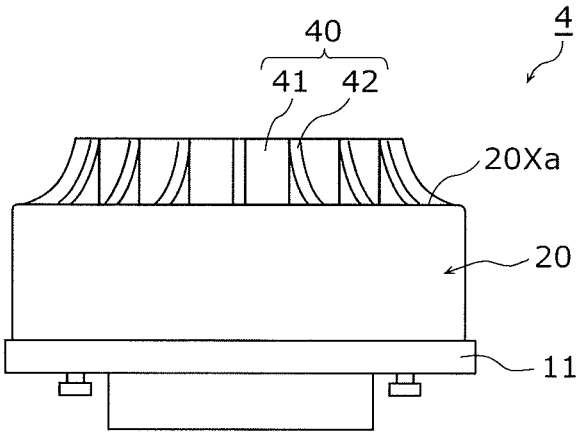
FIG. 8B is a side view of the lamp according to Modification 2 of the present invention.

As shown in FIG. 8A and FIG. 8B, the lamp 4 according to Modification 2 of the present invention is provided with a heat sink 40 above the protruding portion 20X of the first housing 20. The heat sink 40 includes a heat sink body 41 having a cylindrical shape and a plurality of heat dissipation fins 42 provided around the heat sink body 41. The heat dissipation fins 42 are formed to straddle the interface between the heat sink body 41 and the first exposed surface 20Xa.

As described above, since the heat sink 40 is provided according to this modification, it is possible to increase the surface area for dissipating heat. With this configuration, it is possible to further enhance the heat dissipation performance compared to Embodiment 2. In addition, the heat sink 40 is formed on the protruding portion 20X to face the illuminated area that is a region containing cool external air, and thus it is possible to obtain a high heat dissipation effect.

Modification 3

Figure 9A:
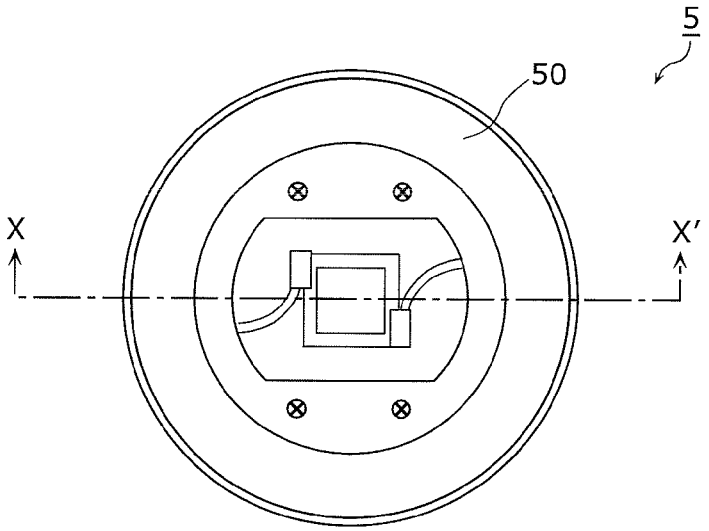
FIG. 9A is a plan view of a lamp according to Modification 3 of the present invention.

Next, a lamp 5 according to Modification 3 of the present invention will be described with reference to FIG. 9A to FIG. 9C. FIG. 9A is a plan view of a lamp according to Modification 3 of the present invention, FIG. 9B is a side view of the lamp according to Modification 3, and FIG. 9C is a cross-sectional view of Modification 3 taken from line illustrated in X-X' in FIG. 9C.

Figure 9B:
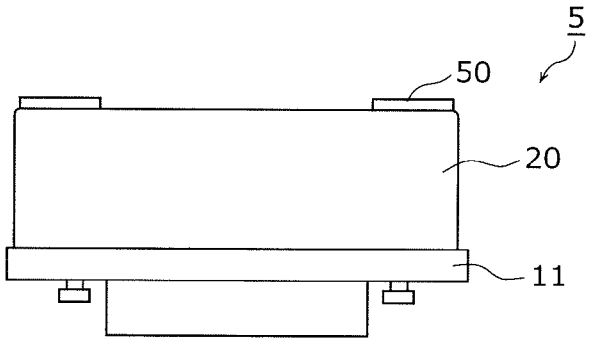
FIG. 9B is a side view of the lamp according to Modification 3 of the present invention.
Figure 9C:
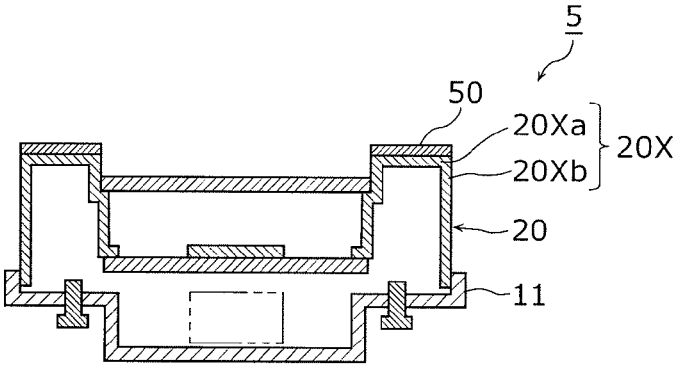
FIG. 9C is a cross-sectional view of the lamp according to Modification 3 of the present invention, which is taken from line X-X' of FIG. 9A.

As shown in FIG. 9A to FIG. 9C, the lamp 5 according to Modification 3 of the present invention includes a heat sink layer 50 having high heat dissipation performance. The heat sink layer 50 is formed on the upper surface of the first exposed surface 20Xa of the protruding portion 20X of the first housing 20. According to the present modification, the heat sink layer 50 is formed into the same annular shape as the first exposed surface 20Xa of the protruding portion 20X. It is to be noted that the heat sink layer 50 can be formed through such methods as applying a coating material having high heat dissipation performance, using a heat dissipation seal, and using a vapor-deposited film. In addition, the position for providing the heat sink layer 50 is not limited to the upper surface of a housing. From the perspective of enhancing the heat dissipation performance, the heat sink layer 50 may be provided on the side surface or/and the entire surface of the first housing 20.

As described above, according to this modification, since the heat sink layer 50 having high heat dissipation performance is provided, it is possible to further enhance the heat dissipation performance compared to Embodiment 2.

Modification 4

Figure 10A:
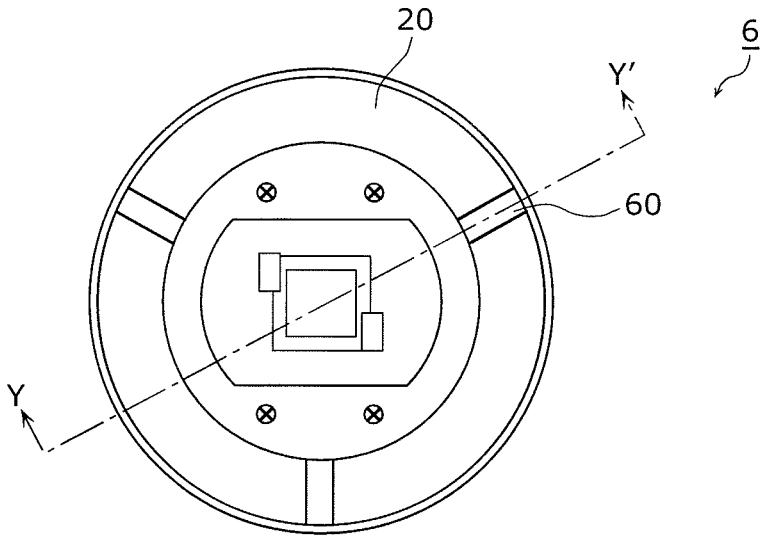
FIG. 10A is a plan view of a lamp according to Modification 4 of the present invention.

Next, a lamp 6 according to Modification 4 of the present invention will be described with reference to FIG. 10A and FIG. 10B. FIG. 10A is a plan view of a lamp according to Modification 4 of the present invention, and FIG. 10B is a cross-sectional view of the lamp according to Modification 4, taken from line Y-Y' illustrated in FIG. 10A.

Figure 10B:
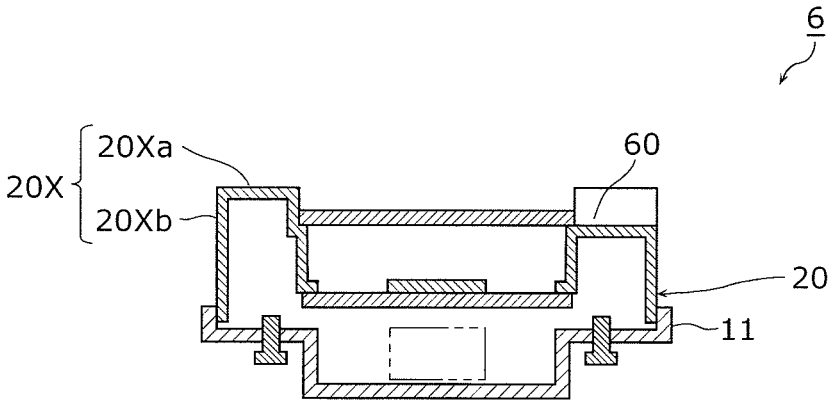
FIG. 10B is a cross-sectional view of the lamp according to Modification 4 of the present invention, which is taken from line Y-Y' of FIG. 10A.

As shown in FIG. 10A and FIG. 10B, the lamp 6 according to Modification 4 of the present invention is provided with grooves 60 each having a predetermined width in the protruding portion of the first housing 20. According to the exemplary embodiment, three grooves 60 are formed at equal intervals as shown in FIG. 10A.

As described above, since the grooves 60 are provided according to this modification, it is possible to increase the surface area for dissipating heat. It is therefore possible to further enhance the heat dissipation performance compared to Embodiment 2.

Modification 5

Figure 11:
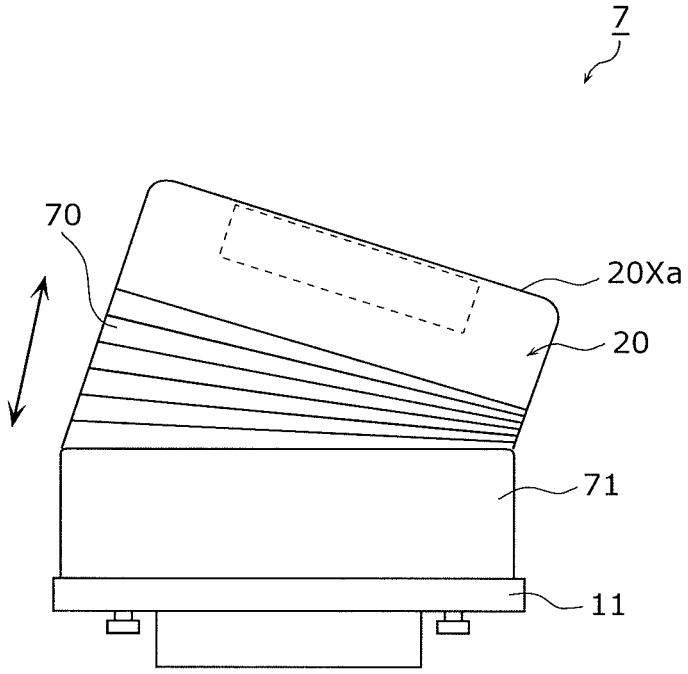
FIG. 11 is a side view of a lamp according to Modification 5 of the present invention.

Next, a lamp 7 according to Modification 5 of the present invention will be described with reference to FIG. 11. FIG. 11 is a side view of a lamp according to Modification 5 of the present invention.

As shown in FIG. 11, the lamp 7 according to Modification 5 of the present invention includes a fixed portion 71 attached to the second housing 11 and a bellows portion 70 attached to the fixed portion 71. The first housing 20 is attached to the bellows portion 70. The bellows portion 70 is formed to be stretchable, and the position of the first housing 20 changes in conjunction with a stretching motion of the bellows portion 70.

As described above, according to this modification, it is possible to change the position of the first housing 20 using the bellows portion 70. It is therefore possible to adjust the position of the first housing 20 such that the first housing 20 sticks out of the equipment body when the lamp 7 is attached to the lighting equipment. With this configuration, it is possible to further efficiently dissipate heat conducted to the first housing 20.

Working Example

Next, a working example of the lamp according to Embodiment 1 and Embodiment 2 of the present invention will be described.

First, materials and sizes of the first housing and the second housing were examined. Table 1 shows a result of the examination.

In the examination of the working example, since the second housing 11 includes a base portion which needs to be insulated, only the material for the side surface of the outermost circumference of the second housing 11 was changed. In addition, the temperature of not the LED chips themselves but the LED mounting board was measured. This is because there is correlation between the LED chips and the LED mounting board, and also it is easier to measure the temperature of the LED mounting board.

It is to be noted that, although no illustration is provided, temperatures were measured through fixed-point observation of a specific point. In addition, temperatures were measured by using the same LED mounting board and the same lighting circuit.

In addition, the lamp was attached to the lighting equipment and power was supplied at a voltage of 100V and frequency of 60 Hz. An ambient temperature was adjusted to 30±1 degrees Celsius under the draught free environment, and one hour wait time was provided so that the temperature was sufficiently stabilized.

TABLE 1

| | h3 [mm] | Material of the first housing | Material of the second housing | Outermost diameter of housing [mm] | Temperature of LED mounting board [deg C.] | Temperature of base top panel [deg C.] |
|---|---|---|---|---|---|---|
| Comparison 1 | 15 | PBT | Al | ϕ90 | 80 | 59 |
| Example 1 | 0 | Al | PBT | ϕ90 | 79 | 54 |
| Example 2 | 15 | Al | PBT | ϕ90 | 71 | 51 |
| Example 3 | 15 | Al | Al | ϕ90 | 66 | 52 |
| Example 4 | 15 | Al | PBT | ϕ90 | 78 | 53 |

In Table 1, Example 1 corresponds to Embodiment 1 described above, and Examples 2 to 4 correspond to Embodiment 2 described above. In addition, Comparison 1 is an example where the material of the first housing is PBT and the material of the second housing is aluminum in Embodiment 2. In Table 1, "h3" denotes a protrusion length of the protruding portion 20X of the first housing 20, measured from the LED mounting board 12*a*, and "Outermost diameter of housing" is the larger one of the outermost diameters of the first housings 10 and 20, and the second housing 11.

When Comparison 1 and Example 1 are compared, Table 1 shows that it is possible to enhance the heat dissipation performance without the protruding portion 20X as in Example 1, by using aluminum for the material of the first housing 10 and PBT for the material of the second housing 11. More specifically, it is possible to enhance the heat dissipation performance by setting the thermal conductivity of the first housing 10 to be higher than the thermal conductivity of the second housing 11. This is thought to be due to the heat being retained inside the lighting equipment in Comparison 1.

In addition, as the result of Example 1 (without protruding portion) and Example 2 (with protruding portion) shows, it is possible to further enhance the heat dissipation performance by providing the protruding portion 20X.

In addition, as the result of Example 2 and Example 3 shows, it is possible to further enhance the heat dissipation performance by using aluminum for the material of the second housing 11 as well. It is to be noted that, when the heat dissipation effect in Embodiment 2 is sufficient as heat dissipation effect, the second housing 11 made of resin is more easily handled because it is possible to integrally mold with the base portion and to avoid exposure of a metal cut edge.

It is to be noted that, as the result of Example 2 and Example 4 shows, it is preferable that the outermost diameter of the housing be larger.

Figure 12:
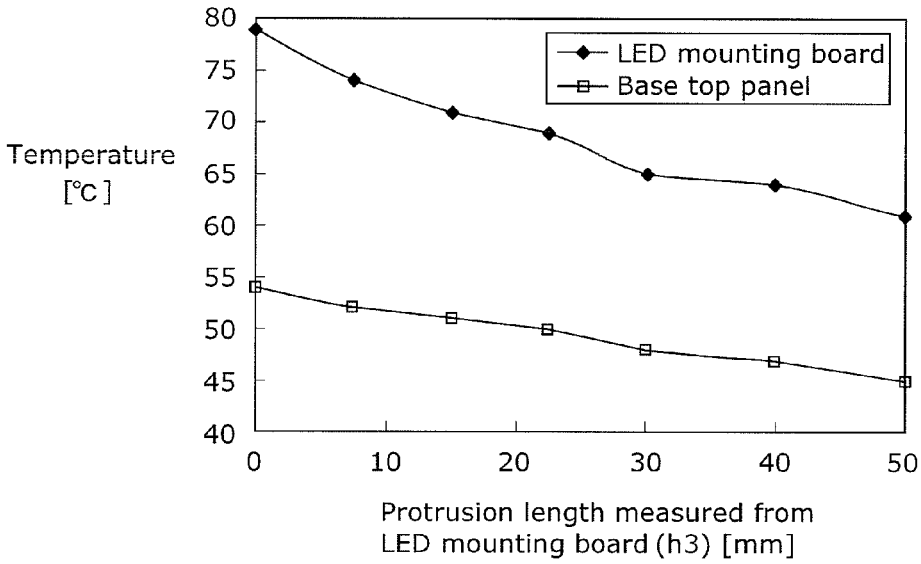
FIG. 12 is a diagram illustrating relationships between a protrusion length h3 of a protruding portion of a first housing and temperatures of an LED mounting board and a base top panel when the protrusion length h3 is varied in the lamp according to the exemplary embodiments of the present invention.

The following describes relationship between heat dissipation and the protrusion length h3 of the protruding portion 20X of the first housing 20 which is measured from the LED mounting board 12*a*, with reference to FIG. 12. FIG. 12 is a diagram illustrating relationships between the protrusion length h3 of the protruding portion of the first housing and temperatures of the LED mounting board and the base top panel when the protrusion length h3 is varied. It is to be noted that, in FIG. 12, aluminum was used for the material of the first housing 20 and PBT was used for the material of the second housing 11. In addition, the distance between the base reference surface of the second housing 11 and the LED mounting board 12*a* was set to 15 mm and the outermost diameter of the housing was set to 90 mm.

In addition, in the case of h3=30 mm in FIG. 12, an end face of the lamp in the illuminated area and an end face of the lighting equipment in the illuminated area are located at substantially the same position. Accordingly, in the case of h3=40 mm, the lamp (the protruding portion 20X) protrudes by approximately 10 mm from the lighting equipment (equipment body), and in the case of h3=50 mm, the lamp (the protruding portion 20X) protrudes by approximately 20 mm from the lighting equipment (equipment body).

FIG. 12 shows that the lager the protruding portion 20X of the first housing 20 is, the more the temperatures of the LED mounting board 12*a* and the base top panel decrease, and thus the heat dissipation performance enhances. It shows that when h3 is larger than or equal to 30 mm, in particular, the heat dissipation effect significantly increases.

Figure 13:
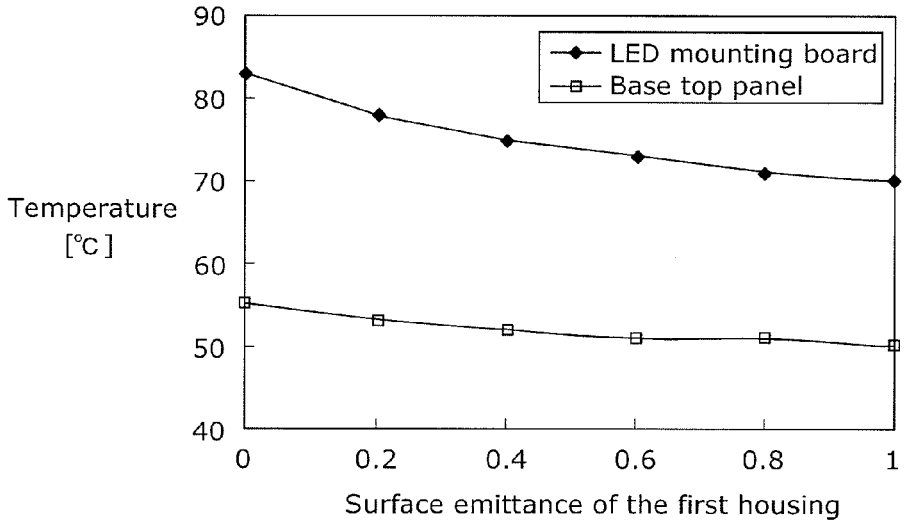
FIG. 13 is a diagram illustrating relationships between an surface emittance of the first housing and temperatures of the LED mounting board and the base top panel in the lamp according to the exemplary embodiments of the present invention.

The following describes relationship between heat dissipation and surface emittance of the first housing 20, with reference to FIG. 13. FIG. 13 is a diagram illustrating relationships between the surface emittance of the first housing 20 and temperatures of the LED mounting board 12*a* and the base top panel. It is to be noted that, in FIG. 13, aluminum was used for the material of the first housing 20 and PBT was used for the material of the second housing 11. In addition, the distance between the base reference surface of the second housing 11 and the LED mounting board 12*a* was set to 15 mm, the outermost diameter of the housing was set to 90 mm, and the protrusion length h3 of the protruding portion 20X of the first housing 20 was set to 15 mm. It is to be noted that alumite treatment was performed on an outer surface of the first housing 20, and the emittance was set to 0.8.

FIG. 13 shows that the higher the surface emittance of the first housing 20 is, the more the temperatures of the LED mounting board 12*a* and the base top panel decrease, and thus the heat dissipation performance enhances. This is thought to be due to the following reason.

Heat transfer caused by natural convection or the like cannot be expected too much in the state where the lamp is attached to the lighting equipment, however, heat transfer or heat radiation to external air (atmosphere) plays a significant role in heat dissipation of a lamp, and thus a contribution of heat radiation, actually, cannot be entirely ignored in some cases.

Heat dispersed widely onto the surface of a housing with high thermal conductivity is also dissipated into the atmosphere or a surrounding object as a result of radiation phenomenon, and the amount of heat transferred is determined by thermal emittance on the surface of the housing. For example, in the case where the housing is formed of aluminum, the emittance is lower than 0.1 when the surface is untreated, but the emittance increases to 0.7 to 0.9 when the surface is alumited. In addition to the metal surface treatment, it is possible to obtain a similar effect by applying a coating material having high emittance on the surface of the housing. The upper limit of the emittance is 1.0 in either case, and it is possible to obtain a greater heat dissipation effect when the emittance is higher.

However, as shown in FIG. 13, the heat dissipation effect is saturated when the emittance exceeds around 0.6, and there is not much difference after that. Accordingly, it is preferable that the emittance of the surface of the first housing 20 be set to 0.6 or higher. For example, in the exemplary embodiment, the surface of the first housing 20 is alumited so that the emittance of the first housing 20 is increased to approximately 0.8.

The lamp and the lighting apparatus according to the present invention have been described above based on each of the exemplary embodiments, modifications, and examples. However, the present invention is not limited to these exemplary embodiments, modifications, and examples.

For example, the first housings 10 and 20 are formed of aluminum according to the above-described exemplary embodiments, however, the materials for the first housings 10 and 20 are not limited to aluminum. It is preferable that at least the first exposed surfaces 10*a* and 20Xa of the first housings 10 and 20 be made of a material having thermal conductivity higher than thermal conductivity of glass (1.4 W/m·K), in other words, a material having thermal conductivity of at least 10 W/m·K or higher. For example, metal materials such as stainless steel having thermal conductivity of 16 W/m·K, iron having thermal conductivity of 80 W/m·K, and copper having thermal conductivity of 398 W/m·K, may be used, or inorganic materials such as alumina having thermal conductivity of 36 W/m·K, aluminum nitride having thermal conductivity of approximately 100 W/m·K, silicon having thermal conductivity of 1148 W/m·K, and beryllia having thermal conductivity of approximately 272 W/m·K, may be used.

This is because heat dissipation depends on heat transfer or heat radiation to cool external air which is in contact with the surface of the first housing facing the illuminated area, rather than natural convection. Accordingly, for rapid and wide diffusion of heat generated in an LED, it is preferable that a material having thermal conductivity higher than or equal to 10 W/m·K be employed.

Figure 14A:
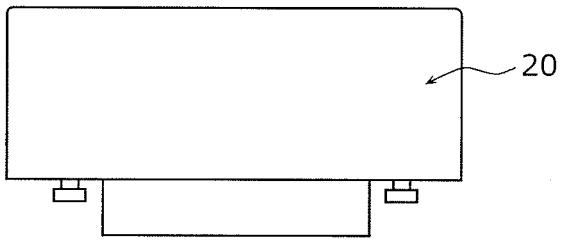
FIG. 14A is a side view illustrating a configuration of a lamp according to another modification of the present invention.
Figure 14B:
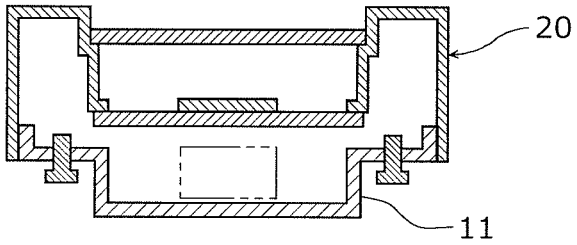
FIG. 14B is a cross-sectional view of the lamp according to the other modification of the present invention.

In addition, the first housing 10 or 20 and the second housing 11 are fitted such that the inner face of the second housing 11 abuts on the outer face of the first housing 10 or 20 according to the exemplary embodiments described above, however, the configuration is not limited to this. For example, as shown in FIG. 14A and FIG. 14B, the first housing 20 and the second housing can be fitted together such that the outer face of the second housing 11 abuts on the inner face of the first housing 20. More specifically, the first housing 20 is formed so as to cover the second housing 11. With this configuration, it is possible to increase the exposed portion of the first housing 20 having high thermal conductivity, and thus the heat dissipation performance can further be enhanced.

In addition, a cylindrical member is used for the first housing 10 and 20 or the second housing 11 according to the exemplary embodiments described above, however, the configuration is not limited to this. For example, a polygonal column shape such as a quadrangular prism, a pentagonal prism, a hexagonal prism, and an octagonal prism, or a circular truncated cone shape may be employed.

In addition, the light source mounting member 13 is separate from the first housings 10 and 20 according to the exemplary embodiments described above, however, the light source mounting member 13 and the first housings 10 and 20 may be integrally formed so as to be an integrated body. Thermal resistance disappears by forming the light source mounting member 13 and the first housings 10 and 20 into an integrated body, and thus it is possible to enhance the heat dissipation performance. It is to be noted that, as to the second housing 11, the base portion need not necessarily be integrated with the housing portion, but may be separately formed.

In addition, although the first housings 10 and 20 have a hollow structure formed as a result of drawing according to the exemplary embodiments described above, they may have a solid structure such as a die-cast processed product. Furthermore, although the second housing 11 has a hollow structure such as an injection molded item, the second housing 11 may have a solid structure. It is to be noted that the outer shape of the first housings 10 and 20 and the second housing 11 may be a tapered shape or a curved shape with a rounded surface.

In addition, the lighting circuit 17 is disposed within the lamp according to the exemplary embodiments, however, the position is not limited to this. The lighting circuit 17 may be disposed outside the lamp by attaching the lighting circuit 17 to the lighting equipment, for example. However, it is preferable that the lighting circuit 17 be stored within the lamp as in the exemplary embodiments.

In addition, in the above-described exemplary embodiments, an optical component such as a lens, a reflector, and the like for collecting light from the LED module 12, or an optical filter and the like for adjusting color may be used, for example. However, these components are not essential structural elements of the present invention.

In addition, the second housing is described as including the base pin 16 which has a GX53 base formed to extend in the direction of the lighting equipment area, for example, however, the base pin may have a base formed to extend laterally (in the horizontal direction) from the side surface of the protruding portion 11*b* of the second housing 11

In addition, although an LED is used as an example of a semiconductor light-emitting element in the above-described exemplary embodiments, it is also possible to use another semiconductor light-emitting element such as a semiconductor laser and an organic EL (Electro Luminescence).

Other forms in which various modifications apparent to those skilled in the art are applied to the exemplary embodiments are also included within the scope of the present invention, unless such changes and modifications depart from the scope of the present invention. In addition, structural elements in plural embodiments, modifications, and examples may be arbitrarily combined, unless such combination departs from the scope of the present invention.

INDUSTRIAL APPLICABILITY

The lamp according to the present invention can be widely used as a flat lamp such as a lamp having a GX53 base, for example.

REFERENCE SIGNS LIST

1, 2, 3, 4, 5, 6, 7 lamp
10, 20 first housing
10*a*, 20Xa first exposed surface
10*b*, 20Xb second exposed surface
11 second housing
11*a* base portion
11*b*, 20X protruding portion
12 LED module
12*a* LED mounting board (mounting board)
12*b* light emitting unit
13 light source mounting member
14 power supply terminal
15, 22 translucent cover
16 base pin
17 lighting circuit
21 screw
30, 42 heat dissipation fins
40 heat sink
41 heat sink body
50 heat sink layer
60 groove
70 bellows portion
71 fixed portion
100 lighting apparatus
110 equipment body
111 flat plate portion
112 cylindrical portion
120 socket
121 insertion hole
122 coupling hole

The invention claimed is:

1. A lamp, comprising:

a translucent cover;

a mounting board on which a semiconductor light-emitting element is mounted;

a first housing comprising a metal plate and thermally coupled with the mounting board, the first housing including a first un-covered exterior surface, a second un-covered exterior surface and a third un-covered exterior surface; and a second housing including a power receiving unit configured to receive power for causing the semiconductor light-emitting element to emit light, wherein the first housing is disposed closer to an illuminated area than the second housing is, and wherein the second housing has a thermal conductivity that is lower than a thermal conductivity of the first un-covered exterior surface, wherein a metal bended part of the first housing connects the first un-covered exterior surface and the second un-covered exterior surface, and further connects the first un-covered exterior surface to the third un-covered exterior surface, wherein the second un-covered exterior surface and the third un-covered exterior surface extend parallel to the radial symmetrical center axis of the lamp, wherein the first un-covered exterior surface extends perpendicular to the radial symmetrical center axis of the lamp, wherein the translucent cover is retained by the third un-covered exterior surface such that the translucent covered is closer to the mounting board than the first un-covered exterior surface.

2. The lamp according to claim 1, further comprising a translucent cover disposed closer to the illuminated area than the mounting board is.

3. The lamp according to claim 1, wherein the first housing includes a protruding portion which protrudes toward the illuminated area to be higher than the mounting board, and the protruding portion has, as the first un-covered exterior surface, a surface facing the illuminated area.

4. The lamp according to claim 3, wherein the protruding portion is formed into an annular shape to enclose the mounting board.

5. The lamp according to claim 3, wherein the protruding portion has a height which is measured from the mounting board and which is set such that the protruding portion is formed in a region outside a range of a ½ beam angle of light emitted from the semiconductor light-emitting element.

6. The lamp according to claim 3, wherein $h3<(D3-DL)/2\times3^{1/2}$, where h3 denotes a height of the protruding portion measured from the mounting board, D3 denotes an inner diameter of the protruding portion at an end facing the illuminated area, and DL denotes a maximum diameter of a region in which a sealing member for covering the semiconductor light-emitting device is formed.

7. The lamp according to claim 1, wherein the first housing has thermal conductivity higher than thermal conductivity of glass.

8. The lamp according to claim 1, wherein the first housing has thermal emittance greater than or equal to 0.6.

9. A lighting apparatus comprising:

the lamp according to claim 1; and lighting equipment to which the lamp is attached, wherein the lighting equipment includes:

an equipment body formed to cover the lamp, and a socket attached to the equipment body for supplying power to the lamp.

10. A lamp, comprising:

a mounting board on which a semiconductor light-emitting element is mounted;

a first housing thermally coupled with the mounting board, the first housing including a first un-covered exterior surface, a second un-covered exterior surface and a third un-covered exterior surface;

a second housing including a power receiving unit configured to receive power for causing the semiconductor light-emitting element to emit light, wherein the first housing is disposed closer to an illuminated area than the second housing is, and wherein the first un-covered exterior surface, the second un-covered exterior surface and the third un-covered exterior surface of the first housing defines a protruding portion which protrudes toward the illuminated area to be higher than the mounting board, wherein the first un-covered surface is formed on an end of the protruding portion in a direction away from the mounting board, and a translucent cover that is disposed closer to the illuminated area than the mounting board is, wherein the translucent cover is fixed to the third un-covered exterior surface, wherein the protruding portion protrudes toward the illuminated area such that the first un-covered exterior surface, in a direction of a radial symmetrical center axis of the lamp, is spaced farther from the semiconductor light-emitting element than a forward-most surface of the translucent cover.

11. The lamp according to claim 1, wherein the second housing comprises a resin material.

12. The lamp according to claim 1, wherein the lamp is greater in width than in height.

13. The lamp according to claim 10, wherein an entire outer periphery of the translucent cover is surrounded by the inner wall surface of the protruding portion.

14. The lamp according to claim 1, wherein a portion of the cylindrical outer surface of the first housing, which defines the second un-covered exterior surface, abuts an inner cylindrical side surface of a base portion of the second housing.

15. A lamp, comprising:

a translucent cover;

a mounting board on which a semiconductor light-emitting element is mounted;

a first housing comprising a metal plate and thermally coupled with the mounting board, the first housing including a first un-covered exterior surface, a second un-covered exterior surface and a third un-covered exterior surface; and a second housing including a power receiving unit configured to receive power for causing the semiconductor light-emitting element to emit light, the first housing is disposed closer to an illuminated area than the second housing is, and the first housing including the first un-covered exterior surface exposed at least to the illuminated area, and the second housing has a thermal conductivity that is lower than a thermal conductivity of the first un-covered exterior surface, the second un-covered exterior surface being defined by an outer cylindrical surface provided at a lateral side of the lamp and the third un-covered exterior surface being defined by an inner cylindrical surface surrounded by the second un-covered exterior surface, wherein an annular space is defined radially between the inner cylindrical surface and the outer cylindrical surface, wherein the translucent cover is retained by the third un-covered exterior surface such that the translucent covered is closer to the mounting board than the first un-covered exterior surface.

16. A lamp, comprising:

a translucent cover;

a mounting board on which a semiconductor light-emitting element is mounted;

a first housing formed of a metal plate and thermally coupled with the mounting board, the first housing including a first un-covered exterior surface, a second un-covered exterior surface and a third un-covered exterior surface that together define a protruding portion; and a second housing including a power receiving unit configured to receive power for causing the semiconductor light-emitting element to emit light, wherein the first housing is disposed closer to an illuminated area than the second housing is, and the first un-covered exterior surface is exposed at least to the illuminated area, and wherein the second housing has a thermal conductivity that is lower than a thermal conductivity of the first un-covered exterior surface, wherein the second un-covered exterior surface is defined by an outer cylindrical surface exposed to a lateral side of the lamp, wherein the protruding portion protrudes toward the illuminated area to be higher than the mounting board, wherein the translucent cover is retained by the protruding portion, and wherein the protruding portion protrudes toward the illuminated area such that, in a direction of a radial symmetrical center axis of the lamp, the first un-covered exterior surface is spaced farther from the semiconductor light-emitting element than a forward-most surface of the translucent cover.

* * * * *